US007838192B2

(12) United States Patent
Scheuer et al.

(10) Patent No.: US 7,838,192 B2
(45) Date of Patent: Nov. 23, 2010

(54) METHODS FOR MAKING CUSTOMIZED BLACK TONERS

(75) Inventors: Mark Scheuer, Williamson, NY (US); Mark Petrush, Webster, NY (US); James Winters, Alfred Station, NY (US); John Ianni, Medina, NY (US); Julia Kohlmeier, Penfield, NY (US); William Hollenbaugh, Jr., Rochester, NY (US); Kip Jugle, Bloomfield, NY (US); Jeffrey McEwen, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 803 days.

(21) Appl. No.: 11/789,419

(22) Filed: Apr. 24, 2007

(65) Prior Publication Data

US 2008/0268364 A1 Oct. 30, 2008

(51) Int. Cl.
*G03G 9/00* (2006.01)

(52) U.S. Cl. ..... 430/107.1
(58) Field of Classification Search ..... 430/107.1
See application file for complete search history.

(56) References Cited

U.S. PATENT DOCUMENTS

| | | | | |
|---|---|---|---|---|
| 2,297,691 | A | 10/1942 | Carlson | |
| 4,427,412 | A * | 1/1984 | Gorondy | 8/471 |
| 4,897,330 | A * | 1/1990 | Shoji et al. | 430/54 |
| 4,985,327 | A * | 1/1991 | Sakashita et al. | 430/110.4 |
| 5,149,610 | A * | 9/1992 | Kobayashi et al. | 430/109.4 |
| 5,313,233 | A * | 5/1994 | Nagase et al. | 347/140 |
| 5,352,553 | A * | 10/1994 | Takeuchi et al. | 430/47.5 |
| 5,415,963 | A * | 5/1995 | Toya et al. | 430/107.1 |
| 5,556,727 | A | 9/1996 | Ciccarelli et al. | |
| 6,120,959 | A * | 9/2000 | Sugizaki et al. | 430/108.9 |
| 6,326,119 | B1 * | 12/2001 | Hollenbaugh et al. | 430/137.2 |
| 6,365,316 | B1 | 4/2002 | Stamp et al. | |
| 6,462,821 | B1 | 10/2002 | Borton et al. | |
| 6,651,894 | B2 * | 11/2003 | Nimura et al. | 235/494 |
| 6,824,942 | B2 | 11/2004 | Silence et al. | |
| 6,850,725 | B2 | 2/2005 | Silence et al. | |
| 2004/0197694 | A1 * | 10/2004 | Hayami et al. | 430/109.4 |
| 2008/0261142 | A1 * | 10/2008 | Kittle et al. | 430/111.4 |

* cited by examiner

*Primary Examiner*—Hoa V Le
(74) *Attorney, Agent, or Firm*—Pillsbury Winthrop Shaw Pittman LLP

(57) ABSTRACT

According to embodiments illustrated herein, there is provided a black toner having a resin, an optional additive, and at least two or more colored pigments, and the at least two or more colored pigments are selected from the group consisting of a blue pigment, a green pigment, a red pigment, a magenta pigment, a cyan pigment, a yellow pigment, a white pigment, and mixtures thereof, and the black toner has a calorimetric value L* of about less than 30.

8 Claims, 2 Drawing Sheets

METHODS FOR MAKING CUSTOMIZED BLACK TONERS

TECHNICAL FIELD

The presently disclosed embodiments are generally directed to pigmented black toner compositions for the development of a latent image formed in electrophotography, electrostatography, and the like. More specifically, the present embodiments are directed generally to a customized pigmented black toner that is prepared by combining at least two or more colored pigments such that the toner scatters light to a degree similar to the at least two or more colored pigments.

BACKGROUND

Electrophotography, which is a method for visualizing image information by forming an electrostatic latent image, is currently employed in various fields. The term "electrostatographic" is generally used interchangeably with the term "electrophotographic." In general, electrophotography comprises the formation of an electrostatic latent image on a photoreceptor, followed by development of the image with a developer containing a toner, and subsequent transfer of the image onto a transfer material such as paper or a sheet, and fixing the image on the transfer material by utilizing heat, a solvent, pressure and/or the like to obtain a permanent image.

The basic electrophotographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely divided electroscopic material referred to in the art as "toner". The toner will normally be attracted to those areas of the layer which retain a charge, thereby forming a toner image corresponding to the latent electrostatic image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired.

Generally, standard process controls systems may be used to monitor the application of toners. The system measures the scattered light from the primary colored toners developed in a solid area patch. However, the control parameters of these systems need to be changed when used to monitor the application of black toners. The switching of parameters is due to the fact that carbon black is typically used to create black toners. Whereas colored toners are known to scatter infrared light (940 nm), black toners made from carbon black absorb such light. Thus, the parameters of the process controls system must be changed during the electrophotographic process to accommodate the use of such black toners.

These additional steps to accommodate the use of the black toners increase the time of the electrophotographic process and add levels of complexity to the electrophotographic system's control system.

Therefore, there is a need for a black toner that exhibits similar light scattering qualities as primary colored toners and thus can be monitored by a process controls system using the same parameters as those used for primary colored toners.

The use of such black toner will quicken the electrophotographic process and eliminate the additional steps presently taken by the control system.

BRIEF SUMMARY

According to embodiments illustrated herein, there is provided a black toner comprising a resin, an optional additive, and at least two or more colored pigments, wherein the at least two or more colored pigments are selected from a group consisting of a blue pigment, a green pigment, a red pigment, a magenta pigment, a cyan pigment, a yellow pigment, a white pigment, and mixtures thereof, wherein the black toner has a calorimetric value L* of about less than 30, of from about 10 to about 30, and calorimetric values a* and b* of from about −10.0 to about +10.0. Another embodiment may include the black toner having colorimetric values L* of from about 23 to about 25, a* of from about 0.05 to about 0.25, and b* of from about 1.0 to about 2.0.

An embodiment may include a black toner comprising a resin, an optional additive, a blue pigment, a green pigment, and a red pigment, wherein the black toner has a colorimetric value L* of about less than 30, of from about 10 to about 30. Another embodiment may include the black toner having calorimetric values L* of from about 23 to about 25, a* of from about 0.05 to about 0.25, and b* of from about 1.0 to about 2.0.

An embodiment may include a method for making a pigmented black toner, comprising combining a resin, an optional additive, and at least two or more colored pigments, wherein the at least two colored pigments are selected from a group consisting of a blue pigment, a green pigment, a red pigment, a magenta pigment, a cyan pigment, a yellow pigment, a white pigment, and mixtures thereof, wherein the black toner has a calorimetric value L* of about less than 30, of from about 10 to about 30. Another embodiment may include the black toner having calorimetric values L* of from about 23 to about 25, a* of from about 0.05 to about 0.25, and b* of from about 1.0 to about 2.0.

DETAILED DESCRIPTION

Figure 1:
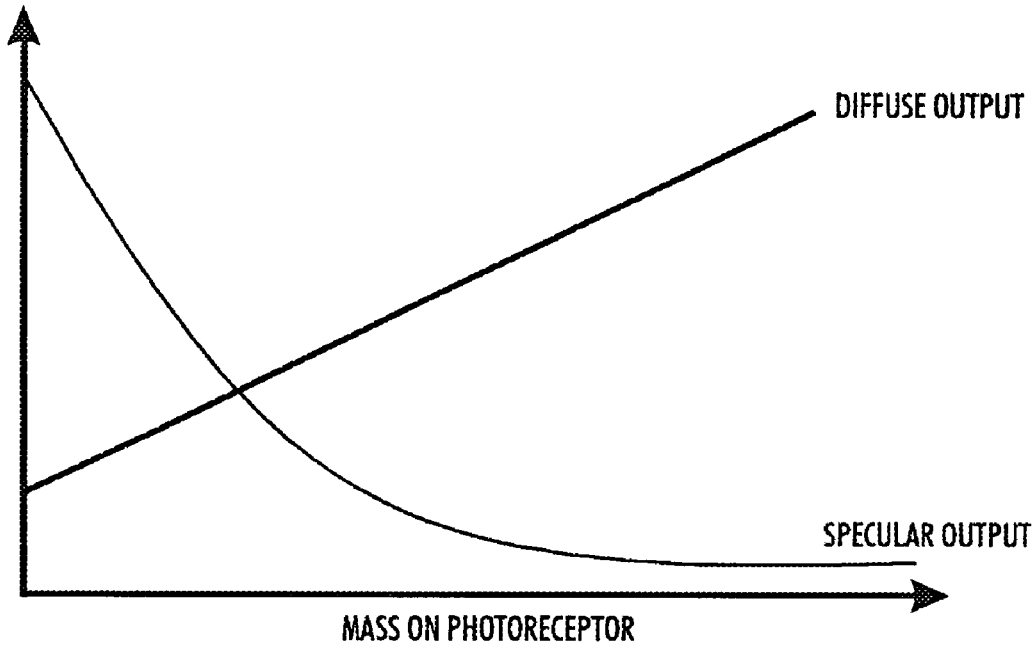
FIG. 1 is a graph of measurements of the outputs of an Extended Toner Area Coverage Sensor ("ETACS")

In the following description, it is understood that other embodiments may be used and structural and operational changes may be made without departing from the scope of the present disclosure.

The present embodiments relate to the creation of a pigmented black toner that does not absorb infrared light, but rather scatters light equally to the other primary toners, such as for example, red, blue, green, magenta, cyan, yellow, and white.

In creating arbitrary colored toners using dry blending, in order to obtain colors with a darkness (L*) of about less than 30, black toners are used.

Carbon black is typically used to create black toners.

However, during the formation of an electrostatic latent image on the photoreceptor, followed by development of the image with a developer containing a toner, to maintain solid area performance, the electrophotographic system's control system uses diffuse reflection of about 940 nm via an Extended Toner Area Coverage Sensor ("ETACS").

Because the carbon black absorbs infrared light at 940 nm, the electrophotographic system's control system must undertake additional steps during the electrophotographic process to accommodate the use of carbon black toners.

These additional steps increase the time of the electrophotographic process and add levels of complexity to the electrophotographic system's control system.

Therefore, a black toner that does not absorb infrared light, but rather scatters light equally to the other primary toners (red, blue, green, magenta, cyan, yellow, and white), is needed to quicken the electrophotographic process and to eliminate these additional steps taken by the controls system.

Carbon black is unsuitable because it does not scatter light. Therefore, a black toner comprised of one or more colored pigments that scatters light equally to the other primary toners is needed.

In embodiments, toner can comprise a resin, wax, colorant, and optional additives such as a charge control agent. Such toners are disclosed in, for example, U.S. Pat. Nos. 6,326,119; 6,365,316; 6,824,942 and 6,850,725, the disclosures of which are hereby incorporated by reference in their entireties. The toner will be described below:

Resin

The toner resin can be a partially crosslinked unsaturated resin such as unsaturated polyester prepared by crosslinking a linear unsaturated resin (hereinafter called base resin), such as linear unsaturated polyester resin, in embodiments, with a chemical initiator, through a reactive extrusion in a melt mixing device such as, for example, an extruder at high temperature (e.g., above the glass transition temperature of the resin, and more specifically, up to about 150° C. above that glass transition temperature) and under high shear. Also, the toner resin possesses, for example, a weight fraction of the microgel (gel content) in the resin mixture of from about 0.001 to about 50 weight percent, from about 1 to about 20 weight percent, or about 1 to about 10 weight percent, or from about 2 to about 9 weight percent. The linear portion is comprised of base resin, more specifically unsaturated polyester, in the range of from about 50 to about 99.999 percent by weight of the toner resin, or from about 80 to about 98 percent by weight of the toner resin. More specifically, the range may be between about 81.6 and about 67.1% by weight of linear portion of the resin and between about 7.5 and about 18% by weight of the cross-linked resin portion. The linear portion of the resin may comprise low molecular weight reactive base resin that did not crosslink during the crosslinking reaction, more specifically unsaturated polyester resin.

The molecular weight distribution of the resin is thus bimodal having different ranges for the linear and the crosslinked portions of the binder. The number average molecular weight ($M_n$) of the linear portion as measured by gel permeation chromatography (GPC) is from, for example, about 1,000 to about 20,000, or from about 3,000 to about 8,000. The weight average molecular weight ($M_w$) of the linear portion is from, for example, about 2,000 to about 40,000, or from about 5,000 to about 20,000. The weight average molecular weight of the gel portions is greater than about 1,000,000. The molecular weight distribution ($M_w/M_n$) of the linear portion is from about 1.5 to about 6, or from about 1.8 to about 4. The onset glass transition temperature (Tg) of the linear portion as measured by differential scanning calorimetry (DSC) is from about 50° C. to about 70° C.

The resin includes between about 5% and about 10% by weight of magenta pigment and between about 3% and about 7% by weight of charge control agent.

Moreover, the binder resin, especially the crosslinked polyesters, can provide a low melt toner with a minimum fix temperature of from about 100° C. to about 200° C., or from about 100° C. to about 160° C., or from about 110° C. to about 140° C.; provide the low melt toner with a wide fusing latitude to minimize or prevent offset of the toner onto the fuser roll; and maintain high toner pulverization efficiencies. The toner resins and thus toners, show minimized or substantially no vinyl or document offset.

Examples of unsaturated polyester base resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. An example of a suitable polyester is poly(propoxylated bisphenol A fumarate).

In embodiments, the toner binder resin is generated by the melt extrusion of (a) linear propoxylated bisphenol A fumarate resin, and (b) crosslinked by reactive extrusion of the linear resin with the resulting extrudate comprising a resin with an overall gel content of from about 2 to about 9 weight percent. Linear propoxylated bisphenol A fumarate resin is available under the trade name SPAR II™ from Resana S/A Industrias Quimicas, Sao Paulo Brazil, or as NEOXYL P2294™ or P2297™ from DSM Polymer, Geleen, The Netherlands, for example. For suitable toner storage and prevention of vinyl and document offset, the polyester resin blend more specifically has a Tg range of from, for example, about 52° C. to about 64° C.

Chemical initiators, such as, for example, organic peroxides or azo-compounds, can be used for the preparation of the crosslinked toner resins.

The low melt toners and toner resins may be prepared by a reactive melt mixing process wherein reactive resins are partially crosslinked. For example, low melt toner resins may be fabricated by a reactive melt mixing process comprising (1) melting reactive base resin, thereby forming a polymer melt, in a melt mixing device; (2) initiating crosslinking of the polymer melt, more specifically with a chemical crosslinking initiator and increased reaction temperature; (3) retaining the polymer melt in the melt mixing device for a sufficient residence time that partial crosslinking of the base resin may be achieved; (4) providing sufficiently high shear during the crosslinking reaction to keep the gel particles formed and broken down during shearing and mixing, and well distributed in the polymer melt; (5) optionally devolatilizing the polymer melt to remove any effluent volatiles; and (6) optionally adding additional linear base resin after the crosslinking in order to achieve the desired level of gel content in the end resin. The high temperature reactive melt mixing process allows for very fast crosslinking which enables the production of substantially only microgel particles, and the high shear of the process prevents undue growth of the microgels and enables the microgel particles to be uniformly distributed in the resin.

A reactive melt mixing process is, for example, a process wherein chemical reactions can be affected on the polymer in the melt phase in a melt-mixing device, such as an extruder. In preparing the toner resins, these reactions are used to modify the chemical structure and the molecular weight, and thus the melt rheology and fusing properties of the polymer. Reactive melt mixing is particularly efficient for highly viscous materials, and is advantageous because it requires no solvents, and thus is easily environmentally controlled. Continuous reactive melt mixing process produces reactive material with desired degree of crosslinking. The extruded crosslinked material then quenches to maintain morphology as the material comes out of the extruder.

The resin is present in the toner in an amount of from about 40 to about 98 percent by weight, or from about 70 to about 98 percent by weight. The resin can be melt blended or mixed with a colorant, internal charge control agents, additives, pigment, pigment dispersants, flow additives, embrittling agents, and the like. The resultant product can then be micronized by known methods, such as milling or grinding, to form the desired toner particles.

Waxes

Waxes with, for example, a low molecular weight $M_w$ of from about 1,000 to about 10,000, such as polyethylene, polypropylene, and paraffin waxes, can be included in, or on the toner compositions as, for example, fusing release agents.

Colorants

Various suitable colorants of any color can be present in the toners, including suitable colored pigments, dyes, and mixtures thereof including REGAL 330®; (Cabot), Acetylene Black, Lamp Black, Aniline Black; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX8600™, 8610™; Northern Pigments magnetites, NP-604™, NP 608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Other colorants are magenta colorants of (Pigment Red) PR81:2, CI 45160:3. Illustrative examples of cyans that may be selected include copper tetra (octadecyl sulfonamido) phthalocyanine, x copper phthalocyanine pigment listed in the Color Index as Cl 74160, Cl Pigment Blue, and Anthrathrene Blue, identified in the Color Index as Cl 69810, Special Blue X 2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Forum Yellow SE/GLN, Cl Dispersed Yellow 33 2,5 dimethoxy-4-sulfonanilide phenylazo-4-chloro-2,5-dimethoxy acetoacetanilides, and Permanent Yellow FGL, PY17, CI 21105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5,556,727, the disclosure of which is totally incorporated herein by reference.

Black Toner

An Extended Toner Area Coverage Sensor ("ETACS") is used by the Docutech 180 HLC and iGen3 process controls system to read solid area patches on a photoreceptor, as described by Michael Borton and Fred F. Hubble III in U.S. Pat. No. 6,462,821. The ETACS has an internal light emitting diode operating at 940 nm +/30 nm FWHM and outputs a voltage signal (0-5 volts) on both the specular and diffuse channels. With color materials, the diffuse channel is used to read and control the amount of toner in solid area.

To obtain colors with a darkness (L*) lower than about 30, a black toner must be blended with the other primary toners (red, blue, green, cyan, magenta, yellow, and white).

However, to avoid having to change the controls system, the black toner must scatter the light emitted by the ETACS in a manner identical to the other primary toners.

Measurements of ETACS outputs are shown in FIG. 1. The toner in the specular optical path (angle of incidence=angle of reflection) blocks the signal reflecting off the photoreceptor so increased mass results in lower output. The knee of this curve is typically well below the mass of a solid area. Machines using this type of Infrared Densitometer ("IRD") must utilize a patch generator to create a mid-density patch and the process controls relies on an extrapolation along the developability curve to estimate the mass of the solid area patch, thereby increasing or decreasing either the system's toner concentration and/or development field to obtain the desired mass on the customer's print.

Colored toners, however, are known to scatter the 940 nm light out of the solid angle of the specular photodiode's light path. The ETACS sensor employs diffuse collecting diodes perpendicular to the photoreceptor to capture the diffuse signal scattered by the toner. The zero reading (bare photoreceptor) varies photoreceptor-to-photoreceptor but the output signal increases linearly with mass until the channel reaches saturation at about 4.5 volts. In the iGen3 product, using toner in the range of from about 8 to about 10 micron size, the sensor is capable of detecting up to from about 2 to about 2.5 $mg/cm^2$ before the signal saturates. Thus no patch generator is needed to sense the solid area developed mass which typically runs from about 0.5 to about 1 $mg/cm^2$.

In the process controls system for the highlight colored toner station of the Docutech 180 HLC product, the diffuse channel of the ETACS is used to control solid area performance in the range of from about 0.66 $mg/cm^2$ to about 0.82 $mg/cm^2$, depending on the solid area darkness of the setting chosen by the customer.

Figure 2:
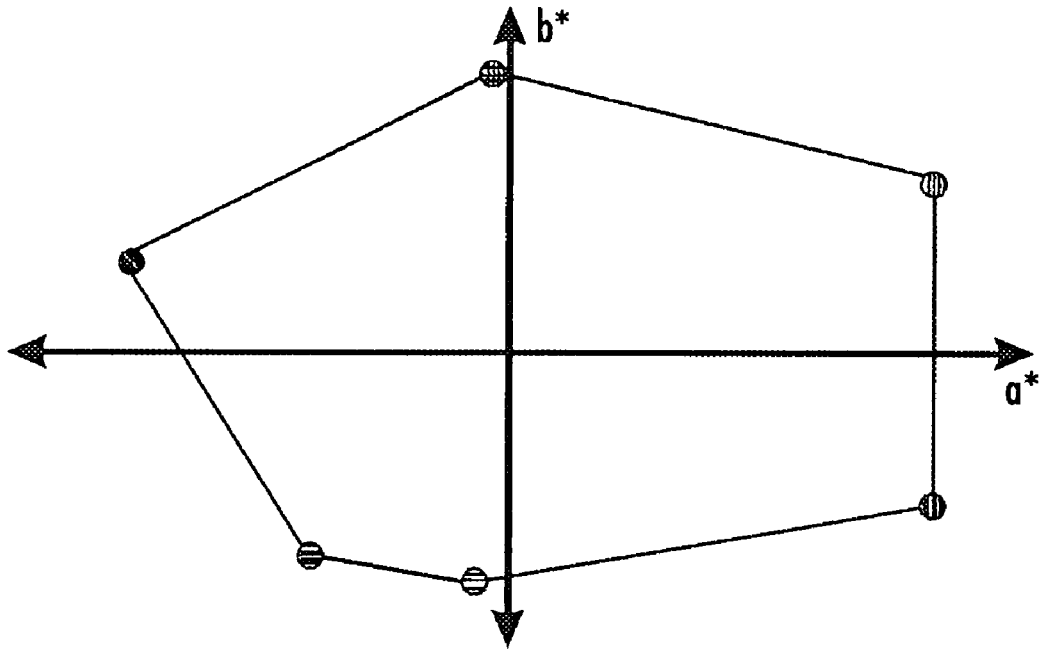
FIG. 2 is a graph of the color space with a* and b* colorimetric coordinates.

In regard to dry blending of highlight colored toners, arbitrary colors within the 3-dimensional color space are created by blending together two or more primary materials including red, blue, green, magenta, cyan, yellow, clear and black in the necessary proportions to create the desired laboratory values of the color mixture. There materials, based on known pigments, can create colors with in the color space, which is shown in FIG. 2.

These primary materials, with the exception of yellow and clear, have darkness (L*) values in the range of from about 45 to about 55. Yellow and clear have darkness (L*) values in the range of from about 90 to about 100. Therefore, to get color mixtures with a darkness below about 30, a black primary toner must be added to the mixture.

Figure 3:
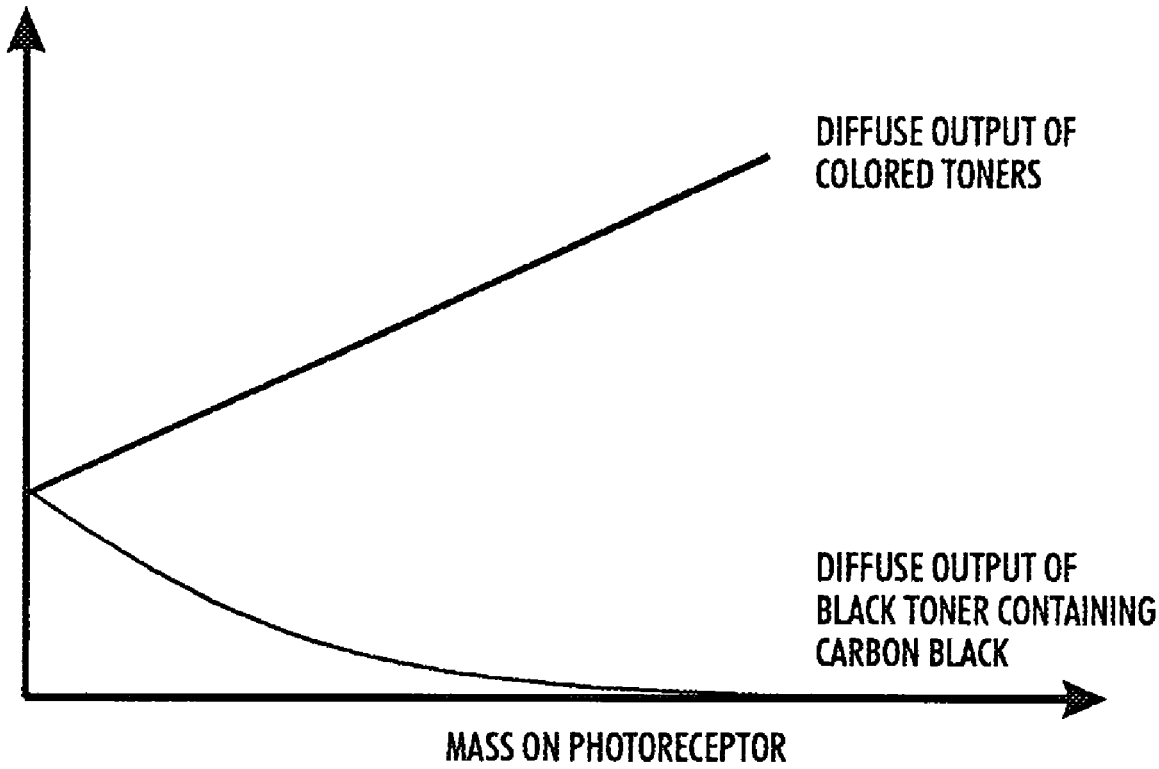
FIG. 3 is a graph of the diffuse output of a black toner containing carbon black.

Black toners containing carbon black, however, do not scatter infrared light but instead absorb it. Since carbon black absorbs scattered light, as more toner is developed on top of the photoreceptor, the light scattered by the photoreceptor is absorbed and the output signal falls to zero. The diffuse output of a black toner containing carbon black is shown in FIG. 3. To use a black toner as a primary colorant to create an arbitrary color via dry blending, and maintaining the current control system that relies on measuring the scattered light from toners developed in a solid area patch, a black toner using pigments without carbon black, that scatters light equally to the other primary toners, is needed.

EXAMPLES

Using the same pigments as the Docutech 180 HLC uses for blue, green, and red toners, a formulation consisting of about 9.97% blue predispersion (91-0787) SUNCODE 349-7715, about 34% green predispersion (91-0831) SUNCODE 364-7736, and about 25.3% red predispersion (91-0830) SUNCODE 334-7706, has the following colorimetric values of L, a*, and b* respectively, 25.6, −0.02, −0.07.

Machine testing with this formulation has shown that the diffuse channel readings of the Extended Toner Area Coverage Sensor ("ETACS") are identical to the other colored toners. To demonstrate this, black toner at about 6.5% toner concentration was loaded into a developer housing. The black toner bottle was removed and a magenta bottle was installed on the developer housing. A print job of about 11% area coverage was run and as the black toner was removed and replaced by magenta toner the color of the toner mixture in the housing and on the prints transitioned from black to magenta in a continuous fashion. During this test, run under full process controls, the control system actuators, i.e., the development field and cleaning field, were maintained within +/−25 volts, showing complete compatibility of the black and magenta toners.

What is claimed is:

1. A pigmented black toner comprising:

a resin;

an additive;

a magenta pigment and a cyan pigment, wherein the pigmented black toner has a colorimetric value L* of from about 23 to about 25;

wherein the resin comprises a microgel in the amount of from 1 to 20 weight percent.

2. The toner of claim 1, wherein the colorimetric values of a* and b* are from about −10.0 to about +10.0.

3. The toner of claim 2, wherein the colorimetric value of a* is from about 0.05 to about 0.25 and the colorimetric value of b* is from about 1.0 to about 2.0.

4. The toner of claim 1, wherein the toner scatters light to a degree similar to the at least one or more colored pigment comprising the toner.

5. A process for making a pigmented black toner, comprising combining:

a resin, an additive, a magenta pigment and a cyan pigment; and forming a pigmented black toner wherein the pigmented black toner has a colorimetric value L* of from about 23 to about 25 and wherein the resin comprises a microgel in the amount of from 1 to 20 weight percent.

6. The process of claim 5, wherein the colorimetric values of a* and b* are from about −10.0 to about +10.0.

7. The process of claim 5, wherein the colorimetric value of a* is from about 0.05 to about 0.25 and the colorimetric value of b* is from about 1.0 to about 2.0.

8. The process of claim 5, wherein the toner scatters light to a degree similar to the at least one or more colored pigment comprising the toner.

* * * * *